US005197370A

United States Patent [19]

Gladfelter

[11] Patent Number: 5,197,370

[45] Date of Patent: Mar. 30, 1993

[54] ABRASION RESISTANT BRAIDED SLEEVE

[75] Inventor: Harry F. Gladfelter, Phoenixville, Pa.

[73] Assignee: The Bentley-Harris Manufacturing Company, Lionville, Pa.

[21] Appl. No.: 845,509

[22] Filed: Feb. 27, 1992

Related U.S. Application Data

[63] Continuation of Ser. No. 689,116, Apr. 22, 1991, abandoned, which is a continuation of Ser. No. 372,878, Jun. 28, 1989, abandoned.

[51] Int. Cl.[5] ..... D04C 1/02

[52] U.S. Cl. ..... 87/7; 87/9

[58] Field of Search ..... 87/2, 5, 6, 7, 8, 9, 87/11, 13; 138/123-127

[56] References Cited

U.S. PATENT DOCUMENTS

| | | | |
|---|---|---|---|
| 4,741,087 | 5/1988 | Plummer, Jr. | 87/7 X |
| 4,754,685 | 7/1988 | Kite et al. | 87/9 |
| 4,777,859 | 10/1988 | Plummer, Jr. | 87/7 |
| 4,836,080 | 6/1989 | Kite, III et al. | 87/9 |

*Primary Examiner*—Joseph J. Hail, III

*Attorney, Agent, or Firm*—Synnestvedt & Lechner

[57] ABSTRACT

Sleeves of braided monofilament formed resilient materials are fabricated incorporating flexible, nonresilient (i.e. limp) multifilament warp yarns. Monofilaments are braided from strands of high modulus engineered plastic materials to provide enhanced pushback and springback propeties in sleeves formed of the braided material. Yarns, such as, spun or texturized yarns, impart body, coverage, and improved tensile strength without sacrificing springback properties. "Loopies", which are characteristic of monofilament warps, are avoided.

9 Claims, 2 Drawing Sheets

ABRASION RESISTANT BRAIDED SLEEVE

This is a continuation application of application Ser. No. 689,116, filed Apr. 22, 1991, (now abandoned), which is in turn a continuation application of Ser. No. 372,878, filed on Jun. 28, 1989, (now abandoned).

FIELD OF THE INVENTION

This invention relates to braided products in general, and in particular, to braided tubular sleeving which can be placed over various substrates, such as, wire bundles, pipes, conduits, electrical cables, air hoses, and the like, to provide abrasion resistance and improved appearance.

BACKGROUND OF THE INVENTION

Some substrates, such as electrical wire or cable, are overbraided with wire to provide electrical shielding, and other substrates, such as hydraulic hoses, are overbraided with wire or other materials to provide increased strength characteristics. In both instances, the overbraiding can also provide increased abrasion resistance and durability for the product. However, in many instances it is impractical to overbraid such substrates with a desired exterior material. For example, electrical wires and cables are frequently installed in computer installations and particularly in robotic installations where it is desirable to bundle a number of wires or cables together and retrofit a flexible sleeving over the wire or cable bundle at the time of installation, or sometime after the original installation. In other circumstances, it is desirable to protect other conduits such as air hoses, water hoses, or other hoses by retrofitting sleeving over the hose at the time of installation, or thereafter.

Braided tubular sleeving has conventionally been used as a field-installed protective sleeving. One such product is the EXPANDO self-fitting protective oversleeve made by The Bentley-Harris Manufacturing Company, Lionville, Pa. The EXPANDO sleeving is a braided tubular product made from a resilient engineering plastic yarn, such as a monofilament polyester. The EXPANDO oversleeve is particularly well suited for field installation over wire and cable bundles or harnesses, hoses, and the like, because the sleeving material has an open weave construction which enables the braided tube to expand up to three times its original diameter when the braided tube is axially compressed. When the axial compression is released, the braided tube tends to return to its original smaller diameter due to the resilient nature of the engineering plastic yarn from which it is braided. This "springback" property gives the braided sleeving the desirable characteristic of being self-fitting. The sleeving therefore can conform to any size bundle which is larger than the original diameter of the sleeve and to any irregular shape. Once installed on the bundle, the braided sleeving tends to remain tightly conformed to the exterior of the bundle. Since the braided open weave construction of the oversleeving is very flexible, the oversleeving easily conforms to the shape of the underlying bundle during any bending and flexing of the bundle, thus, providing continuous protection.

SUMMARY OF THE INVENTION

This invention provides a braided tubular, abrasion resistant sleeve comprising a resilient monofilament strand combined with nonresilient, limp multifilament warp yarn; the warp yarn preferably being of larger diameter in relation to the monofilament. Preferably, the resilient yarn comprises an engineering plastic having a tensile modulus of at least 100,000 psi and the warp yarns are spun or texturized yarns.

The preferred resilient yarn comprises polyester and the preferred warp yarn comprises any limp, nonresilient natural or synthetic multifilament yarn and may be a texturized or spun yarn. Within these broad parameters, the particular warp yarn chosen will be dependent upon the desired end purpose.

An important objective of the invention is to provide abrasion resistant braided sleeves which have improved coverage and tensile strength properties without sacrificing the desirable springback property of such sleeves.

A still further object of the invention is the use of warp yarns in a braided resilient sleeve for longitudinal stiffness, coverage and dimensional stability, without impairment of the pushback and springback capability of the braided tubular structure.

A still further object of the invention is to provide warp yarns in a braided sleeve which eliminate the tendency to loop and snag as the braided structure is expanded and then contracted.

DETAILED DESCRIPTION OF THE INVENTION

Figure 1:
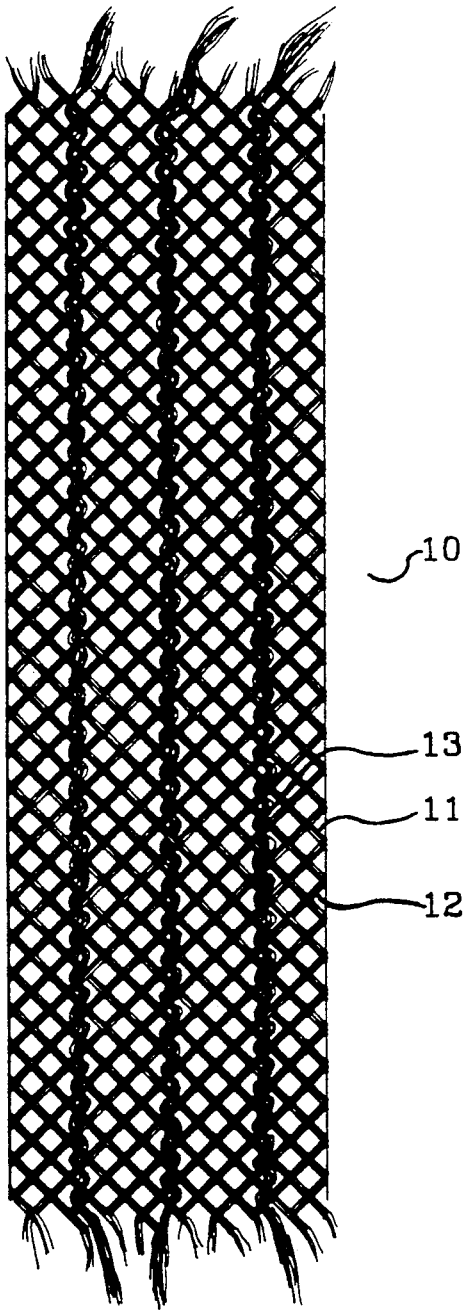
FIG. 1 shows a braided sleeve constructed according to the present invention.

Although flat braiding techniques may be employed, the braided products formed by the teachings of this invention may be fabricated using conventional circular braiding equipment. As is recognized in the art, a circular braider is provided with a ring of studs distributed in uniformly spaced relationship around the braider with each stud receiving a spool of strand or yarn. Movement of the spools in sinuous paths produces a braided sleeve of selected properties in a manner known to those of ordinary skill in the art.

In carrying out the invention, spools of engineered plastic monofilament strand each comprised of 1 to about 10 monofilaments are uniformly distributed on the ring of studs. Additional studs between the studs for supporting the spools of monofilament strand are provided for the support of spools for the warp yarns utilized in the present invention. In accordance with the conventional techniques, known to those of ordinary skill in the art, the braider is used to form an open weave braid which is highly flexible and radially expandable to facilitate installation over wire bundles or hoses which may have irregularly shaped connectors or fittings attached. The facility of radially expanding and contracting allows the sleeving to snugly and neatly conform irregularities in the profile of the cable bundle or hose.

The resilient engineered plastic strand useful in this invention should have sufficient tensile modulus to provide the desired springback characteristic in the braided sleeving. Preferably, the strand used is polyester, but it will be appreciated that any of the family of plastics known as engineered plastics are suitable for use in the sleeves of this invention. By resilient engineered plastics, it is meant that the plastic has a tensile modulus of greater than 100,000 psi, and preferably greater than 150,000 psi, and more preferably, at least 200,000 psi. Examples of engineered plastics are the olefin polymers, of which some preferred olefin polymers are high density polyethylene, polypropylene, polybutene-1, poly 4-methyl pentene, and fluorinated polyolefins, such as ethylene-trifluorochloroethylene copolyers, ethylenetetrafluoroethylene copolymers, and vinylidene fluoride polymers, especially poly-vinylidene fluoride, and blends thereof, for example, the fluorinated olefin blends as described in British patent No. 1,120,131; polyesters, for example, polyethylene terephthalate, polytetramethylene terephathalate for example those treated as described in U.S. Pat. Nos. 3,968,015; 4,073,830 and 4,113,594; polyphenylene-oxide and -sulphide, blends of polyethylene oxide with polystyrene, silicone-carbonate block copolymers, polyketones, such as polyarylether ketones, for example, those described in U.S. Pat. Nos. 3,953,400; 4,024,314; 4,229,564; 3,751,398; 3,914,298; 3,965,146; and 4,111,908; polysulphones, for example, polyaryl sulphones, polyarylether sulphones, polyetherimides, for example those described in U.S. Pat. No. 3,847,867, polycarbonates especially those derived from bis phenol-A, polyamides, especially those described in U.S. Pat. No. 3,551,200 and 3,677,921, epoxy resins and blends of one or more the abovementioned polymeric materials either with each other or with other polymeric materials. Additional discussion of such materials is found in British specification No. 1,529,351. The disclosure of the above patents and specifications are incorporated herein by reference.

Although other monofilament yarns or strands may be employed in forming a one inch internal diameter sleeve, polyester monofilaments having a diameter of abou: 10 mils, such as are available under the trademark ESTRALYN from Johnson Filament of Williston, Vt., are provided in strand form wherein each strand comprises three monofilament ends. The strands are loaded on each of 48 carriers on the braider and are braided to form a sleeve of open weave construction.

A braided sleeve so formed has excellent pushback and springback characteristics so that it readily and easily is made to fit over elongated substrates and is easily radially expanded and contracted so as to snugly fit over irregular surfaces.

In carrying out the objectives of the invention, a sleeve of the type described is modified by the addition of multifilament warp yarns. These warp yarns are preferably spun or texturized yarns. Other yarns may be employed provided that they meet the requirement of being relatively limp. Such yarns may be formed from either natural or synthetic fibers; the synthetic fibers being either organic or inorganic fibers. For applications where it is desirable to increase the density braided and reduce the permeability of the structure, bulkier warp yarns may be employed. For applications where the warp yarns are to be provided to increase the tensile strength of the product, as in, for example, wearing harnesses, where the sleeve provides strain relief, less bulky yarns, characterized by their tensile properties, will be employed. Likewise, the number of warp yarns in relation to the monofilament strands will be dependent upon the end use of the particular product. In conventional braiding equipment, an extra stud provided between each braider bobbin stud may be utilized for a spool of warp yarn. Thus, bobbins of warp yarn may be provided between every other braid strand bobbin for a product having maximum coverage and good pushback and springback characteristics. Where stability or strain relief are the primary requirements, the ratio of warp yarns to monofilaments may vary substantially depending upon the desired properties and the tensile strength of the warp yarns. For example, an end product of open braid construction, where it is desirable to increase the structural stability of the product and provide strain relief while retaining the open construction to allow for air flow, may have warp yarns present in a ratio of 1 to about 2 to 4 braided monofilament strands, by placing the spools of warp yarns between the appropriate groups of spools of braid strands.

Figure 2:
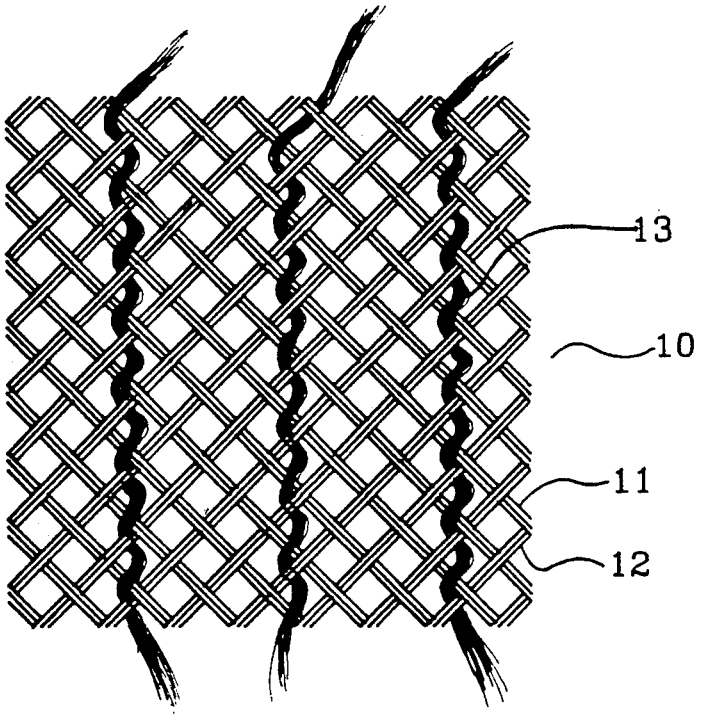
FIG. 2 shows a fragmentary view on an enlarged scale, schematically illustrating the construction of the sleeve of FIG. 1.

A sleeve 10 formed in accordance with the invention is shown in FIGS. 1 and 2. The sleeve comprises strands 11 and 12, each comprising 3 monofilament ends. Warp yarns 13 extend lengthwise along the sleeve.

In using a sleeve formed in accordance with the invention, a portion of the sleeve is pushed back and radially expanded. The relatively limp warp yarns compress and tend to uniformly form very small loops between each of the cross over points in the braided structure. When the braided structure is allowed to springback, the warp yarns return to their original straightened condition within the structure so that none of these loops remain. In contrast, when warp yarns or strands of monofilament are utilized to give the structure body, these warp monofilaments slip relatively to the braided strands and tend to buckle at irregular intervals producing relatively large loops or kinks at the points where buckling takes place. When the braided structure springs back to its original configuration, these loops, commonly called "loopies" by those working in this art, remain. These loopies not only detract from the appearance of the sleeve, they greatly impair its function, since they are easily snagged and broken and are targets for abrasion. Ultimately, they lead to kinks and holes in the harness, destroying its usefulness. In contrast, the multifilament yarns add strain relief, coverage and stability to the braided product without the disadvantage caused by the monofilament loopies.

If desired, the multifilament warp yarns of the invention may comprise filaments coated with a heat activatable adhesive. Sleeves so formed would have the properties of a braided sleeve during installation. Once in place, particularly in applications where abrasion from vibration or movement is a problem, the adhesive can be activated to permanently lock the structure in place.

As indicated above, the warp yarns may be added in a similar fashion to flat braided monofilament sheets. The multifilament warps substantially eliminate the fishnet characteristic of tapes or sheets made of monofilament yarns, eliminate the tendency to form loopies, and the stiffness imparted to such a braided structure when monofilament warps are included.

EXAMPLE

A one inch I.D. sleeve was braided, using a 96 carrier circular braider, from strand comprising three ends of 10 mil monofilament polyester available under the trademark ESTRALYN, sold by Johnson Filament of Williston, Vt. The strand material has a modulus of elasticity of 750,000 psi. Between every 7 carriers there is provided a carrier of texturized warp yarn of 1,000 denier multifilament nylon available under the trademark CORDURA, sold by E.I. DuPont De Nemours. The warp yarn is a limp yarn and can impart to the sleeve improved body and coverage without an impairment of springback characteristics.

I claim:

1. A positionable tubular sleeve comprising braided, resilient strands, wherein each resilient strand is comprised of 1 to 10 monofilaments of an engineering plastic material having a modulus of elasticity of at least 100,000 psi, said braided resilient strands defining a plurality of pair of cross over points within said sleeve, said braided sleeve further comprising uniformly distributed, flexible and substantially nonresilient relatively limp warp yarns interthreaded into said braid, said sleeve having at least a first and second position, whereby:

a portion of said braided, resilient strands in said first position are longitudinally compressed and radially expanded and said limp warp yarns tend to uniformly form very small loops between each of the pairs of cross over points where said warp yarns are located in said longitudinally compressed and radially expanded portion of said braided resilient strands; and in said second position, said portion of said braided resilient strand is longitudinally extended and radially compressed, and said limp warp yarns are substantially straightened so as to substantially retract said loops.

2. A sleeve according to claim 1, comprising one warp yarn for every 1–4 monofilaments.

3. A sleeve according to claim 1, comprising about one warp yarn for every 2 resilient strands.

4. A sleeve according to claim 3, wherein the monofilaments are a polyester.

5. A sleeve according to claim 4, wherein the monofilaments have a diameter of 6 mils to 15 mils.

6. A positionable braided structure for use in forming tubular sleeves or the like, said braided structure being formed of resilient strands, wherein each strand is comprised of at least one monofilament having a modulus of elasticity of at least 100,000 psi; said braided structure defining a plurality of pairs of cross over points therein, said structure further comprising a plurality of relatively limp substantially nonresilient multifolament warp yarns interlaced at predetermined intervals into said braided structure, said structure having at least a first and second position, whereby:

in said first position, a portion of said structure is longitudinally compressed and radially expanded and said multifilament warp yarns tend to uniformly form very small loops between each of the pairs of cross over points where said warp yarns are located in said longitudinally compressed and radially expanded portion of said braided structure; and in said second position, said portion of said braided structure is longitudinally extended and radially compressed, and said multifolament warp yarns are substantially straightened so as to substantially eliminate said small loops.

7. A braided structure according to claim 6, wherein said strand comprises from 2 to 6 polyester monofilaments having a diameter of 6 to 15 mils and a modulus of elasticity of about 750,000 psi.

8. A positionable tubular sleeve comprising a relatively resilient braided structure comprising filaments of an engineering plastic material and containing a plurality of pairs of cross over points therein, said tubular sleeve further comprising uniformly distributed, relatively limp warp yarns interthreaded into said resilient braided structure, said sleeve having at least a first and second position, whereby:

in said first position, a portion of said resilient braided structure is longitudinally compressed and radially expanded and said limp warp yarns tend to uniformly form very small loops between each of the pairs of cross over points where said warp yarns are located in said longitudinally compressed and radially expanded portion of said resilient braided structure; and in said second position, said portion of said resilient braided structure is longitudinally extended and radially compressed, and said limp warp yarns are substantially straightened so as to substantially eliminate said small loops.

9. An axially compressible and expandable tubular sleeve comprising braided, resilient strands, wherein each of the resilient strands is comprised of 1 to 10 monofilaments of an engineering plastic material having a modulus of elasticity of at least 100,000 psi; said braided, resilient strands defining a plurality of pairs of cross over points in said sleeve, said braided sleeve further comprising uniformly distributed, flexible and substantially non-resilient, relatively limp warp yarns interthreaded with the resilient strands in said braided sleeve, said braided sleeve having a portion which is axially compressible and expandable between first and second positions respectively, said warp yarns tending to uniformly form very small warp yarn loops projecting outwardly from the sleeve between each of the cross over points where said warp yarns are located in said portion of said braided sleeve as the sleeve portion is moved from said first, expanded position; said resilient strand and relatively limp warp yarns allowing straightening of the warp yarns to substantially eliminate said warp yarn loops as the sleeve portion is moved from said second, compressed position to said first, expanded position.

* * * * *

UNITED STATES PATENT AND TRADEMARK OFFICE

CERTIFICATE OF CORRECTION

PATENT NO. : 5,197,370

DATED : March 30, 1993

INVENTOR(S) : Gladfelter

It is certified that error appears in the above-identified patent and that said Letters Patent is hereby corrected as shown below:

On the title page, under Abstract, line 6, change "propeties" to --properties--.

Column 3, line 27, "abovementioned" should be --above-mentioned--

Column 3, line 55, delete "braided"

Column 3, line 56, before "structure" insert --braided--

Column 5, line 43, change "multifolament" to --multifilament--

Column 6, line 3, change "multifolament" to --multifilament--

Signed and Sealed this

Fourth Day of January, 1994

*Attest:*

Bruce Lehman

BRUCE LEHMAN

*Attesting Officer*

*Commissioner of Patents and Trademarks*